US012523398B2

(12) United States Patent
Addad et al.

(10) Patent No.: US 12,523,398 B2
(45) Date of Patent: Jan. 13, 2026

(54) VORTEX TUBE INCLUDING SECONDARY INLET WITH SWIRL GENERATOR

(71) Applicant: Khalifa University of Science and Technology, Abu Dhabi (AE)

(72) Inventors: Yacine Addad, Abu Dhabi (AE); Omar Sharief Ibrahim Alyahia, Abu Dhabi (AE)

(73) Assignee: Khalifa University of Science and Technology, Abu Dhabi (AE)

( * ) Notice: Subject to any disclaimer, the term of this patent is extended or adjusted under 35 U.S.C. 154(b) by 0 days.

(21) Appl. No.: 18/569,170

(22) PCT Filed: Jun. 15, 2021

(86) PCT No.: PCT/IB2021/055275
§ 371 (c)(1),
(2) Date: Dec. 11, 2023

(87) PCT Pub. No.: WO2022/263882
PCT Pub. Date: Dec. 22, 2022

(65) Prior Publication Data
US 2024/0353153 A1 Oct. 24, 2024

(51) Int. Cl.
*F25B 9/04* (2006.01)

(52) U.S. Cl.
CPC ..... *F25B 9/04* (2013.01)

(58) Field of Classification Search
CPC ..... F25B 9/04
See application file for complete search history.

(56) References Cited

U.S. PATENT DOCUMENTS

2004/0168716 A1* 9/2004 Gritskevich ..... F25B 9/04 136/205
2006/0150643 A1* 7/2006 Sullivan ..... F25B 9/04 62/89
2008/0209914 A1 9/2008 De Wergifosse et al.
2008/0303283 A1* 12/2008 Sullivan ..... F25B 9/04 290/54

(Continued)

FOREIGN PATENT DOCUMENTS

CN 102071080 B 4/2013
CN 109373628 B * 10/2020 ..... F25B 9/04

(Continued)

OTHER PUBLICATIONS

PCT/IB2021/055275 , "International Search Report and Written Opinion", Mar. 11, 2022, 9 pages.

*Primary Examiner* — Jianying C Atkisson
*Assistant Examiner* — Ibrahim A. Michael Adeniji
(74) *Attorney, Agent, or Firm* — Kilpatrick Townsend & Stockton LLP

(57) ABSTRACT

Vortex Tubes and related methods of separating an airflow into a hot airflow and a cold airflow employ a secondary airflow inlet. A Vortex Tube includes a secondary airflow inlet that injects a swirling airflow aligned with a central region of the lumen of a circulating tube. The secondary airflow inlet includes a swirl generator that generates the vorticity of the swirling airflow. The injected swirling airflow increase the inner vortex strength thereby increasing the temperature difference between the hot airflow and the cold airflow.

16 Claims, 7 Drawing Sheets

(56) References Cited

U.S. PATENT DOCUMENTS

| | | | | |
|---|---|---|---|---|
| 2009/0199573 | A1* | 8/2009 | Tatarinov | F25B 9/04 62/5 |
| 2011/0229834 | A1* | 9/2011 | Salansky | F23C 6/04 431/185 |
| 2016/0200570 | A1* | 7/2016 | Leachman | F25B 9/04 422/222 |
| 2016/0216009 | A1 | 7/2016 | Chen et al. | |
| 2020/0096237 | A1* | 3/2020 | Tunkel | F25B 9/04 |
| 2021/0341181 | A1* | 11/2021 | Wajda | F25B 9/04 |
| 2022/0307734 | A1* | 9/2022 | Lee | F25B 9/04 |

FOREIGN PATENT DOCUMENTS

| | | | | | |
|---|---|---|---|---|---|
| CN | 112028672 | A | * | 12/2020 | C05F 17/979 |
| CN | 113028672 | A | * | 6/2021 | F25B 49/00 |
| CN | 112413917 | B | * | 4/2022 | F25B 9/08 |
| CN | 113531937 | B | * | 3/2025 | C10L 3/101 |
| EP | 2108902 | A2 | | 10/2009 | |
| KR | 101607848 | B1 | | 3/2016 | |

* cited by examiner

VORTEX TUBE INCLUDING SECONDARY INLET WITH SWIRL GENERATOR

This application is a National Stage Entry under 35 U.S.C. 371 of PCT Application No. PCTIB2021055275 filed Jun. 15, 2021, the entire contents of which are hereby incorporated for all purposes in their entirety.

BACKGROUND

A Vortex Tube (VT) (also known as Ranque-Hilsch tube) separates a flow of compressed air into a hot airflow and a cold airflow. A VT can have no moving parts and use no moving parts or refrigerant. VTs are being used as cooling devices in many industrial and engineering applications (e.g., milling, welding, metal turning, metal cutting, drying, electronic devices).

In a conventional VT 10 (as shown in FIG. 1), compressed air 12 is injected into a lumen of a circulating tube 14 through inlet nozzles 16 (e.g., 4 to 8 nozzles). The inlet nozzles 16 induce vorticity in a resulting airflow that flows along an annular region of the lumen. A counter-rotating vorticity is induced in a reverse direction airflow that flows along a central region of the lumen. A cone 18 disposed at a hot airflow outlet 20 forms a partial blockage that induces the reverse direction airflow. The injected compressed air is separated into a hot airflow 22 and a cold airflow 24 within the circulating tube 14. The hot airflow 22 is output from one end of the circulating tube. The cold airflow 24 is output from cold airflow outlet 26 at the other end of the circulating tube 14. A key parameter indicative of performance of a VT is the maximum achievable temperature differences between the hot airflow and the cold airflow. The maximum achievable temperature differences between the hot airflow and the cold airflow has been identified as being a function of the airflow vorticities within the circulating tube, which has been identified as being a function of several parameters, such as inlet pressure magnitude of the compressed air, the number of nozzles, the outlet pressure at the hot exit (usually controlled by cone valve position), and the length and shape of the lumen of the circulating tube.

While efforts have been made to enhance heat transfer efficiency of VTs, the attempts were only able to achieve limited increases in the maximum achievable temperature differences between the hot airflow and the cold airflow. Accordingly, additional improvements to VTs remain of interest.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments described herein are directed to enhanced Vortex Tubes and related methods of separating an airflow into a hot airflow and a cold airflow. In many embodiments, a Vortex Tube includes a secondary airflow inlet that injects a swirling airflow aligned with the central region of the lumen of the circulating tube. In many embodiments, the secondary airflow inlet includes a secondary vortex generator that generates the vorticity of the swirling airflow. The injected swirling airflow increase the inner vortex strength thereby increasing the temperature difference between the hot airflow and the cold airflow.

Accordingly, in one aspect, an airflow separator is provided. The airflow separator is configured to separate an airflow having an airflow temperature into a reduced temperature airflow and increase temperature airflow. The reduce temperature airflow has a reduced airflow temperature less than the inlet airflow temperature. The increased temperature airflow has an increased airflow temperature greater than the inlet airflow temperature. The airflow separator includes a circulating tube, a first vortex generator, a secondary vortex generator, a reduced temperature airflow outlet, and an increase temperature airflow outlet. The circulating tube has a first end and a second end. The circulating tube is elongated along a circulating tube axis. The circulating tube defines an airflow channel having a central portion and an annular portion that surrounds the central portion. The first vortex generator is configured to receive a first portion of the airflow and inject the first portion of the airflow into the annular portion of the airflow channel at the first end with a first airflow vorticity around the circulating tube axis. The secondary vortex generator is configured to receive a second portion of the airflow and inject the second portion of the airflow into the central portion of the airflow channel at the second end with a second airflow vorticity around the circulating tube axis. The reduced temperature airflow outlet is disposed at the first end of the circulating tube. The reduced temperature airflow outlet is configured to receive the reduced temperature airflow from the central portion of the circulating tube. The increased temperature airflow outlet is disposed at the second end of the circulating tube. The increased temperature airflow outlet is configured to receive the increased temperature airflow from the annular portion of the circulating tube.

The airflow channel can have any suitable configuration for accommodating bi-directional rotating airflows. For example, the airflow channel can have a length-to-diameter ratio of between 10.0 and 20.0. In some embodiments, the airflow channel has a length-to-diameter ratio of between 13.8 and 15.8. In many embodiments, the airflow channel is cylindrical. In some embodiments, the airflow channel is axially-symmetric and at least partially non-cylindrical.

The first vortex generator can have any suitable configuration for inducing the first airflow vorticity into the first airflow. For example, the first vortex generator can include any suitable number of nozzles (e.g., two, three, four, five, six, seven, eight, etc.). Each of the nozzles can be configured to inject a respective portion of the first portion of the airflow into the annular portion of the airflow channel in a direction tangential to the annular portion of the airflow channel. In some embodiments, the first vortex generator surrounds an end portion of the reduced temperature airflow outlet.

The secondary vortex generator can have any suitable configuration for inducing the second airflow vorticity into the second airflow. For example, the secondary vortex generator can include helically-shaped vanes that are shaped to induce the second airflow vorticity around the circulating tube axis. In some embodiments, the secondary vortex generator has a length-to-diameter ratio of between 0.8 and 3.0. In some embodiments, the secondary vortex generator has a secondary vortex generator output orifice through which the second portion of the airflow is injected into the central portion of the airflow channel. In some embodiments, the secondary vortex generator output orifice has a diameter in a range of 0.45 to 0.65 of a diameter of the airflow channel.

The increased temperature airflow outlet can have any suitable configuration for receiving and outputting the increased temperature airflow from the annular portion of the airflow channel. For example, in some embodiments, the increased temperature airflow outlet surrounds at least a length of the secondary vortex generator. In many embodiments, the increased temperature airflow outlet has an annularly-shaped outlet orifice that is aligned with the annular portion of the airflow channel.

In many embodiments, the airflow is generated by an air compressor. In some embodiments, the airflow separator includes an air compressor configured to generate the airflow. In many embodiments, a pressure of the first portion of the airflow supplied to the first vortex generator equals a pressure of the second portion of the airflow supplied to the secondary vortex generator. In some embodiments, a flow rate the first portion of the airflow is in a range of 40 to 80 percent of a flow rate of the airflow. In many embodiments, compressed air is supplied to each of the first vortex generator and the secondary vortex generator.

In another aspect, a method of separating an airflow into a reduced temperature airflow and an increased temperature airflow is provided. The airflow has an airflow temperature. The reduced temperature airflow having a reduced airflow temperature less than the airflow temperature. The increased temperature airflow has an increased airflow temperature greater than the airflow temperature. The method includes injecting a first portion of the airflow into an annular portion of a lumen of a circulating tube at a first end of the circulating tube. The circulating tube can have a first end and a second end. The circulating tube can be elongated along a circulating tube axis. In many embodiments, the circulating tube defines an airflow channel having a central portion and an annular portion that surrounds the central portion. The first portion of the airflow is injected into the annular portion of the lumen so as to have a first airflow vorticity around the circulating tube axis. The method further includes injecting a second portion of the airflow into a central portion of the lumen of the circulating tube at a second end of the circulating tube. The second portion of the airflow is injected into the central portion of the lumen so as to have a second airflow vorticity around the circulating tube axis. The method further includes outputting the increased temperature airflow from an increased temperature airflow outlet disposed at the second end of the circulating tube. The increased temperature airflow outlet can be aligned with the annular portion of the lumen of the circulating tube. The method further includes outputting the reduced temperature airflow from a reduced temperature airflow outlet disposed at the first end of the circulating tube. The reduced temperature airflow outlet can be aligned with the central portion of the lumen of the circulating tube.

In many embodiments of the method, the airflow channel is configured to accommodate bi-directional rotating airflows. For example, in many embodiments of the method, the airflow channel has a length-to-diameter ratio of between 10.0 and 20.0. In some embodiments of the method, the airflow channel has a length-to-diameter ratio of between 13.8 and 15.8. In many embodiments of the method, the airflow channel is cylindrical. In some embodiments of the method, the airflow channel is axially-symmetric and at least partially non-cylindrical.

The first portion of the airflow can be injected into the annular portion of the lumen of the circulating tube using any suitable approach. For example, in some embodiments of the method, the injection of the first portion of the airflow into the annular portion of the lumen of the circulating tube at the first end of the circulating tube includes injecting respective portions of the first portion of the airflow in a direction tangential to the annular portion of the airflow channel.

In many embodiments of the method, the airflow is a compressed airflow. For example, in some embodiments of the method further includes operating an air compressor to generate the airflow. In some embodiments of the method, a pressure of the first portion of the airflow supplied to the first vortex generator equals a pressure of the second portion of the airflow supplied to the secondary vortex generator. In some embodiments of the method, a flow rate the first portion of the airflow is in a range of 40.0 to 80 percent of a flow rate of the airflow.

The disclosure describes particular devices and systems for implementing various steps of methods such as those discussed briefly above, but it contemplates any suitable devices and systems for implementing the disclosed steps.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
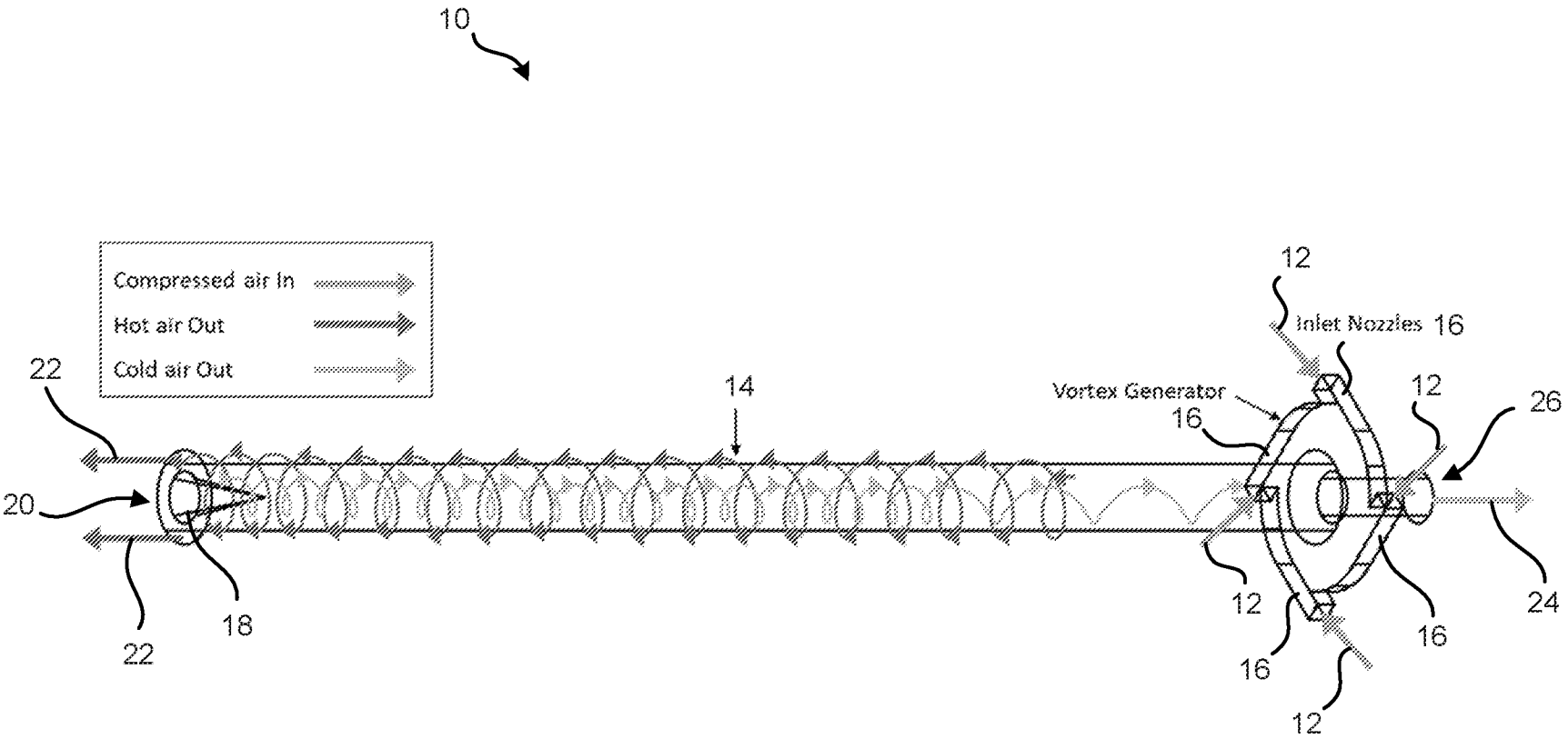
FIG. 1 illustrates a conventional Vortex Tube.
Figure 2:
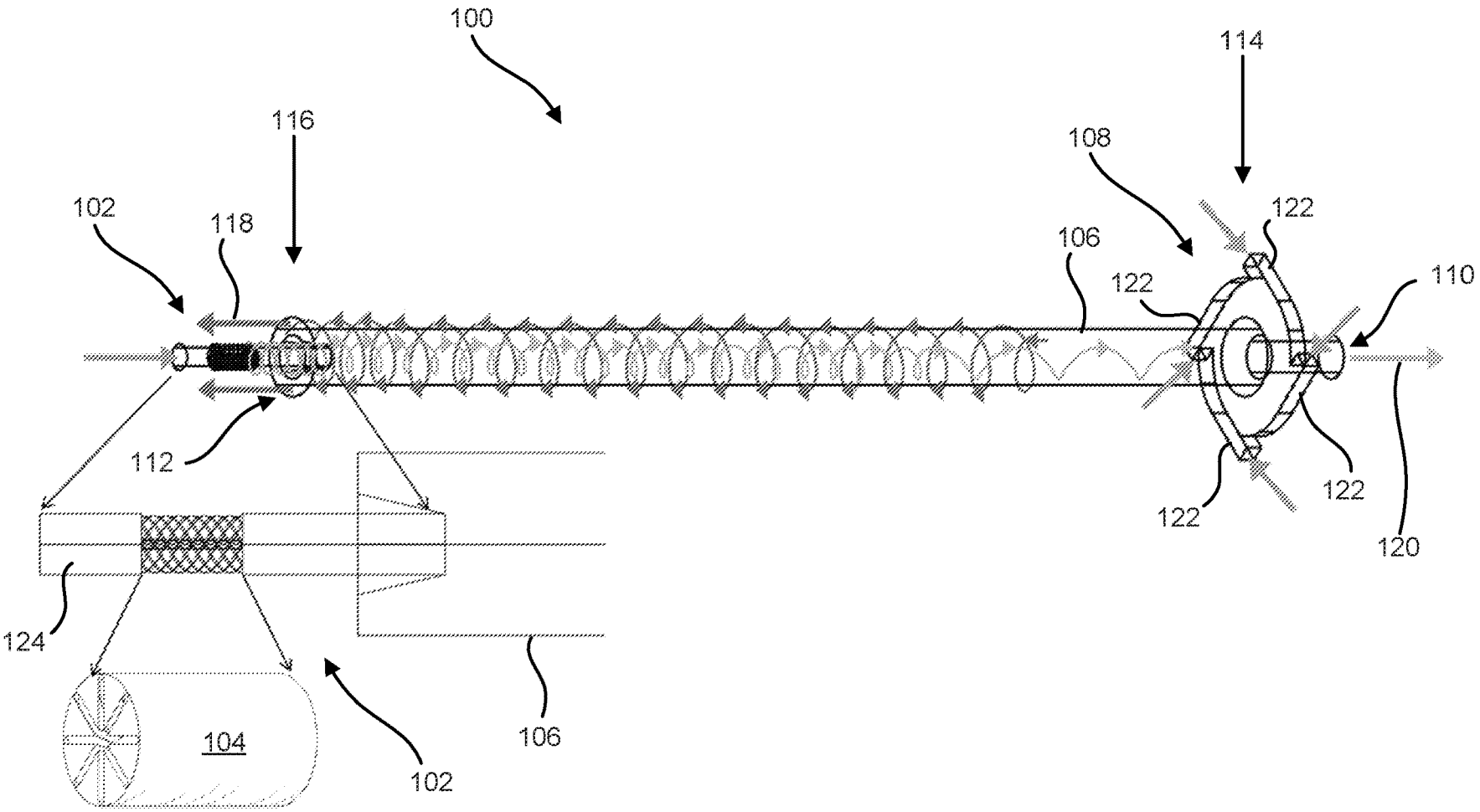
FIG. 2 illustrates a Vortex Tube that includes a secondary inlet with a swirl generator, in accordance with embodiments.

Turning now to the drawing figures, FIG. 2 illustrates a Vortex Tube 100 that includes a secondary inlet 102 (which is also referred to herein as a secondary vortex generator 102) with a swirl generator 104, in accordance with embodiments. The Vortex Tube 100 includes a circulating tube 106, a first vortex generator 108, the secondary vortex generator 102, a reduced temperature airflow outlet 110, and an increased temperature airflow outlet 112. The circulating tube 106 defines a lumen (e.g., a cylindrical lumen or a lumen having any other suitable shape) that extends between a first end 114 of the circulating tube 106 and a second end 116 of the circulating tube 106. The Vortex Tube 100 is configured for separating an airflow into an increased temperature airflow 118 and a reduced temperature airflow 120. The airflow has an airflow temperature. The increased temperature airflow 118 has a temperature greater than the airflow temperature. The reduced temperature airflow 120 has a temperature less than the airflow temperature.

The first vortex generator 108 is configured to receive a first portion of the airflow and inject the first portion of the airflow into an annular portion of the lumen to induce flow of a rotating airflow that flows along the annular portion of the lumen from the first end 114 to the second end 116 of the circulating tube 106. In the illustrated embodiment, the first vortex generator 108 includes four nozzles 122. Each of the nozzles 122 is configured to receive a respective portion of the first portion of the airflow and inject the respective portion into the annular portion of the lumen in a direction tangential to the annular portion of the lumen. The first vortex generator 108 can have any suitable configuration for injecting the first portion of the airflow into an annular portion of the lumen to induce flow of a rotating airflow that flows along the annular portion of the lumen from the first end 114 to the second end 116 of the circulating tube 106. For example, the first vortex generator 108 can have any suitable number (e.g., two, three, four, five, six, seven, eight, or more) of the nozzles 122. In many embodiments, the airflow is a compressed airflow and is supplied to the first vortex generator 108 at a suitable pressure (e.g., 300 kPa).

Figure 4:
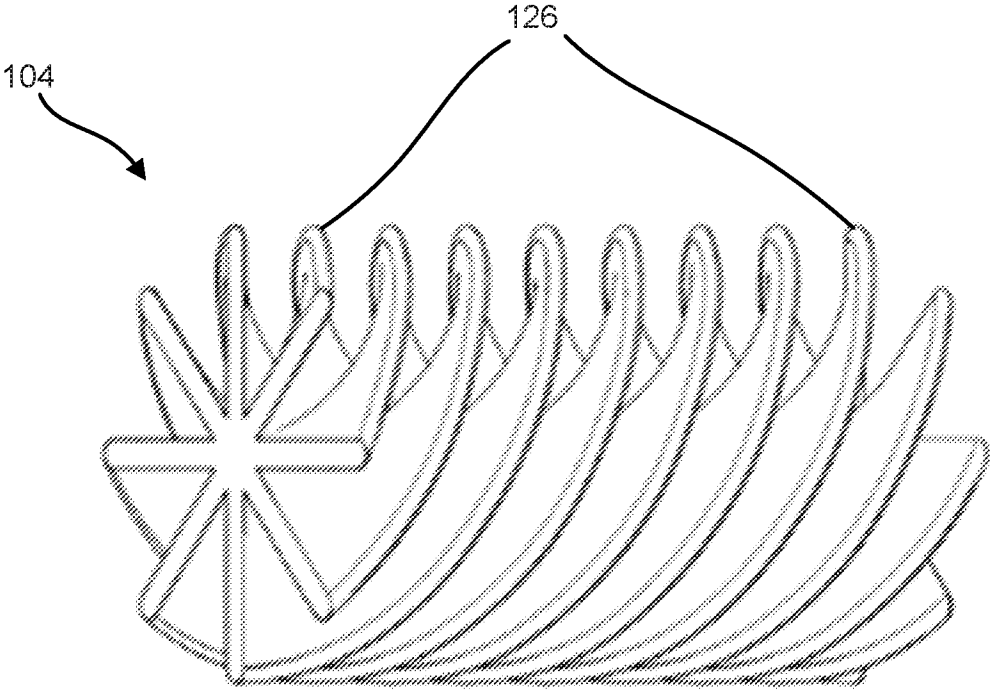
FIG. 4 shows an oblique view of the swirl generator of the Vortex Tube of FIG. 2.
Figure 3:
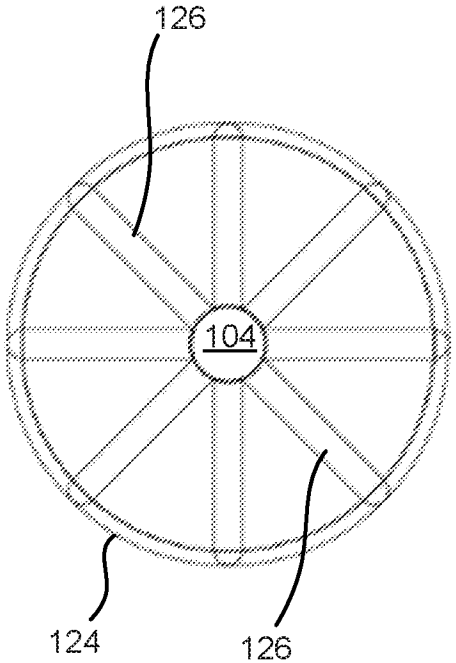
FIG. 3 shows an end view of the swirl generator of the Vortex Tube of FIG. 2.

The secondary vortex generator 102 is configures to receive a second portion of the airflow and inject the second portion of the airflow into a central portion of the lumen to induce flow of a rotating airflow that flows along the central portion of the lumen from the second end 116 to the first end 114 of the circulating tube 106. In the illustrated embodiment, the second vortex generator 102 includes an inlet tube 124 and the swirl generator 104, which is disposed within the inlet tube 124. The swirl generator 104 includes helically-shaped vanes 126 (shown in FIG. 4) configured to generate vorticity in the second portion of the airflow prior to injection of the second portion of the airflow into the central portion of the lumen. The secondary vortex generator 102 can have any suitable configuration for injecting the secondary portion of the airflow into the central portion of the lumen to induce flow of a rotating airflow that flows along the central portion of the lumen from the second end 116 to the first end 114 of the circulating tube 106. For example, in the illustrated embodiment, the swirl generator 104 includes eight helically-shaped vanes 126. Each of the vanes 126 covers a 360 degree arc. FIG. 3 shows an end view of the swirl generator 104. FIG. 4 shows an oblique view of the swirl generator 104.

Figure 5:
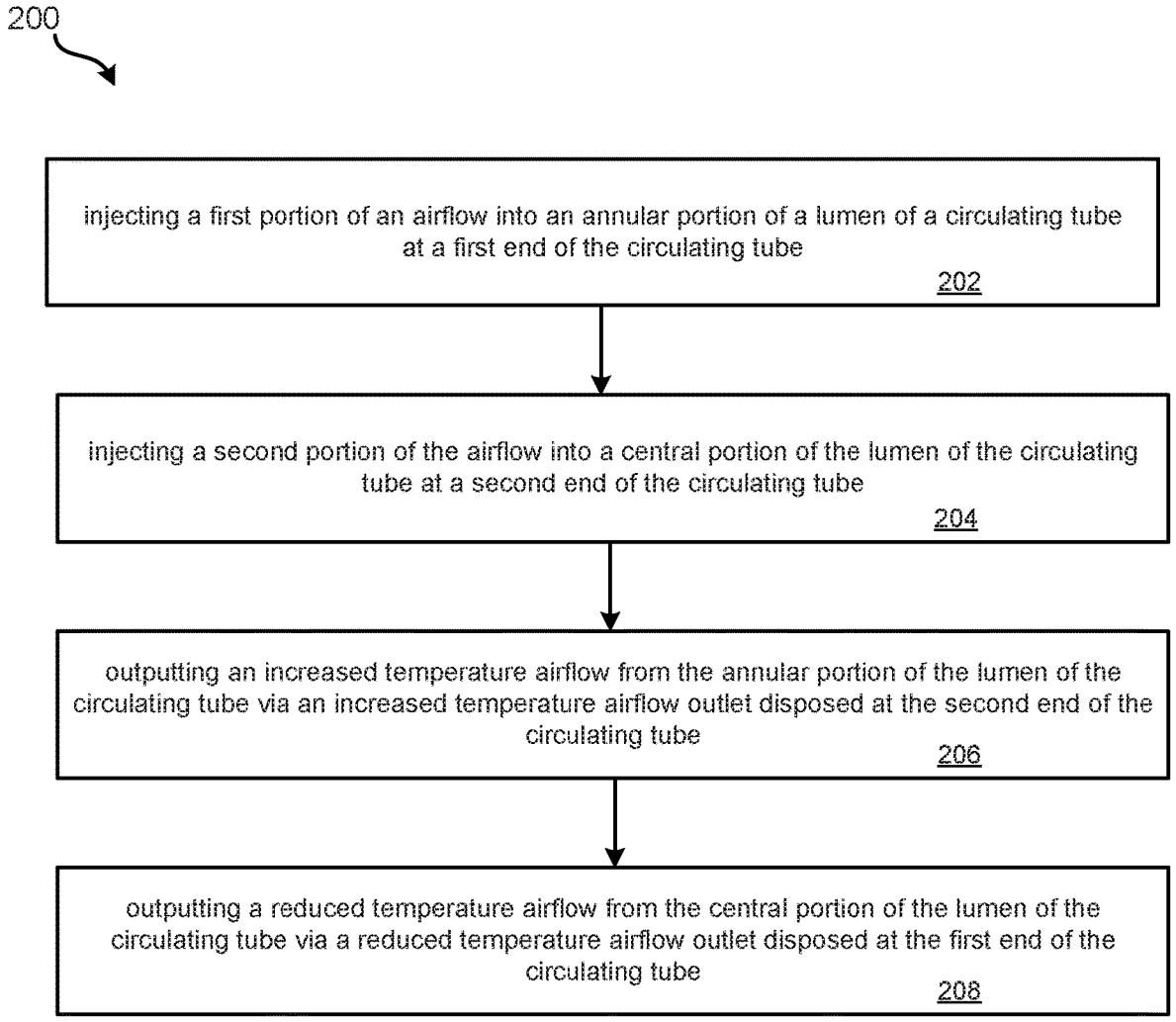
FIG. 5 is a simplified block diagram of a method of separating an airflow into a reduced temperature airflow and an increased temperature airflow, in accordance with embodiments.
Figure 6:
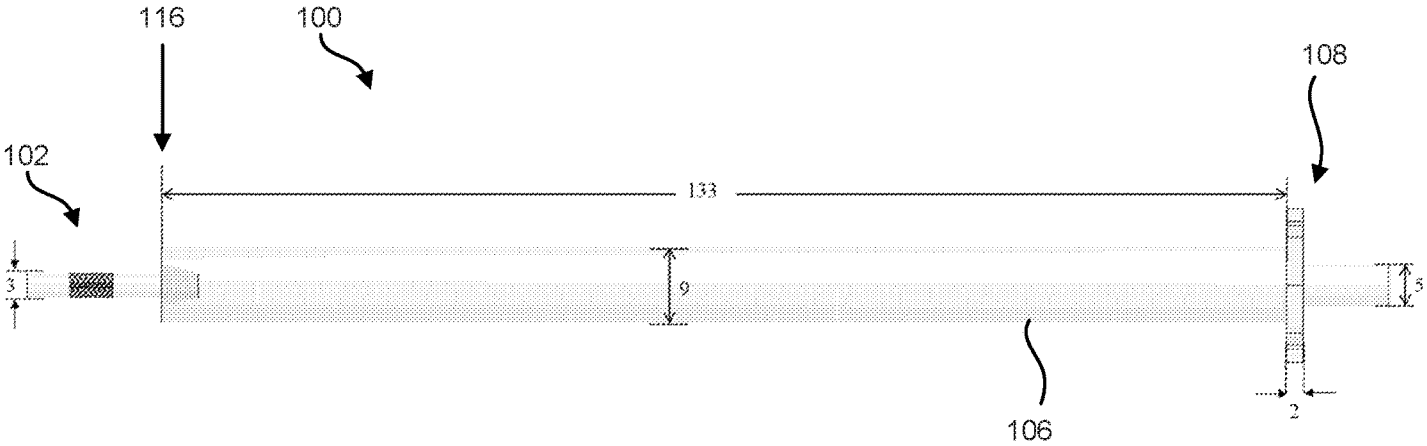
FIG. 6 illustrates dimensions of an example Vortex Tube that includes a secondary inlet with a swirl generator, in accordance with embodiments.
Figure 7:
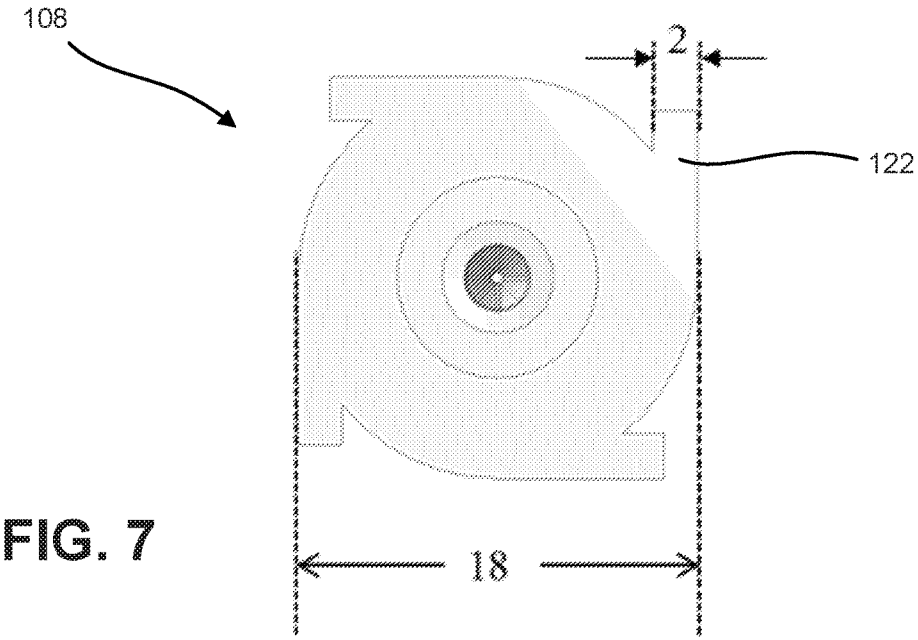
FIG. 7 illustrates dimensions of a first vortex generator of the example Vortex Tube of FIG. 6.
Figure 8:
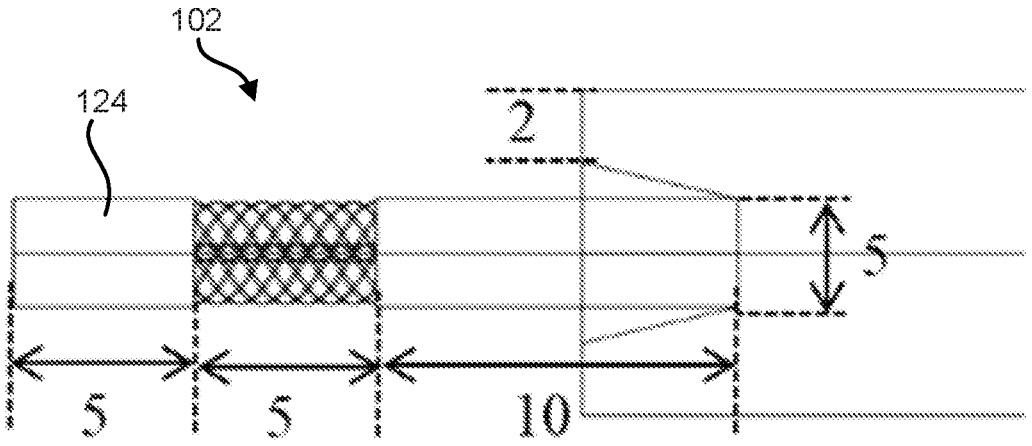
FIG. 8 illustrates dimensions of a secondary vortex generator of the example Vortex Tube of FIG. 6.
Figure 9:
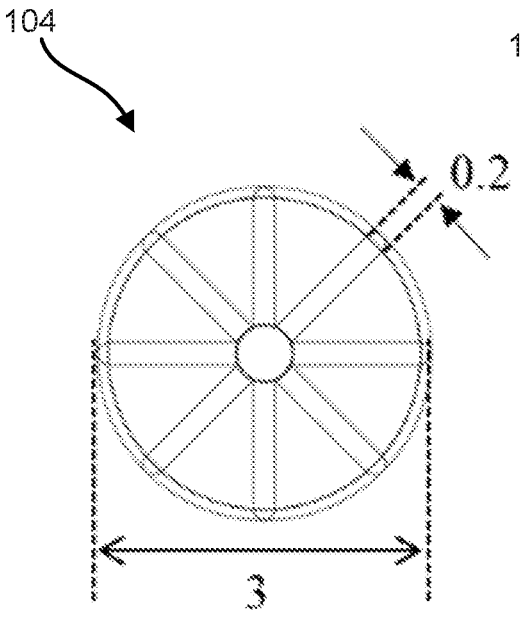
FIG. 9 illustrates dimensions of the swirl generator of the example Vortex Tube of FIG. 6.
Figure 10:
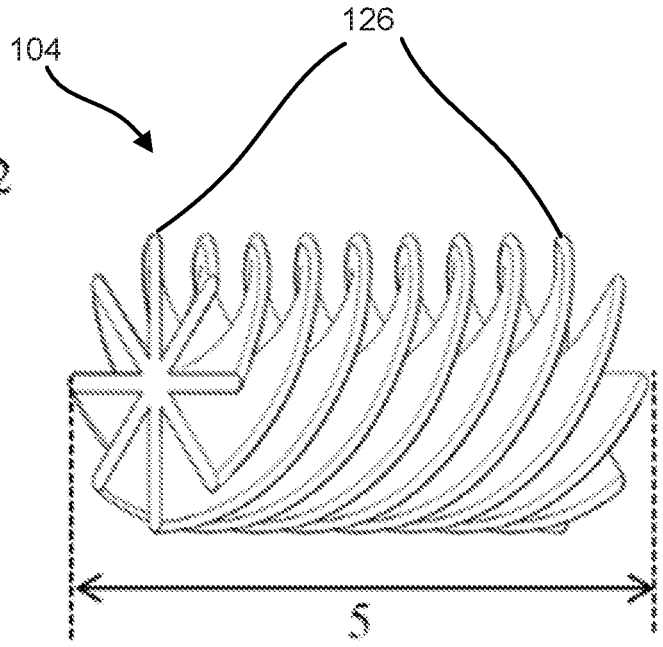
FIG. 10 illustrates a length dimension of the swirl generator of the example Vortex Tube of FIG. 6.

FIG. 5 is a simplified block diagram of a method 200 of separating an airflow into a reduced temperature airflow and an increased temperature airflow, in accordance with embodiments. The method 200 can be practiced using any suitable apparatus, including the Vortex Tube 100 described herein. The airflow has an airflow temperature. The reduced temperature airflow has a reduced airflow temperature less than the airflow temperature. The increased temperature airflow has an increased airflow temperature greater than the airflow temperature. The method 200 includes injecting a first portion of the airflow into an annular portion of a lumen of a circulating tube at a first end of the circulating tube (act 202). The circulating tube has a first end and a second end. The circulating tube is elongated along a circulating tube axis. The circulating tube defines an airflow channel having a central portion and an annular portion that surrounds the central portion. The first portion of the airflow is injected into the annular portion of the lumen so as to have a first airflow vorticity around the circulating tube axis. The method 200 further includes injecting a second portion of the airflow into a central portion of the lumen of the circulating tube at a second end of the circulating tube (act 204). The second portion of the airflow is injected into the central portion of the lumen so as to have a second airflow vorticity around the circulating tube axis. The method 200 further includes outputting the increased temperature airflow from the annular portion of the lumen of the circulating tube via an increased temperature airflow outlet disposed at the second end of the circulating tube (act 206). The method 200 further includes outputting the reduced temperature airflow from the central portion of the lumen of the circulating tube via a reduced temperature airflow outlet disposed at the first end of the circulating tube (act 208).

Prototype Vortex Tube Dimensions

FIG. 6, FIG. 7, FIG. 8, FIG. 9, and FIG. 10 illustrate dimensions of a prototype of the Vortex Tube 100. In the illustrated embodiment, the circulating tube 106 has a length of 133 mm from the first vortex generator 108 to the second end 116 of the circulating tube 106. The circulating tube 106 has an inner diameter of 9 mm. The inlet tube 124 of the secondary vortex generator 102 has an inner diameter of 3 mm. The reduced temperature airflow outlet 110 has an inner diameter of 5 mm. The first vortex generator 108 has an inner diameter of 18 mm. Each of the nozzles 122 of the first vortex generator 108 is 2 mm by 2 mm square. The inlet tube 124 of the secondary vortex generator 102 is 20 mm long. The inlet tube 124 of the secondary vortex generator 102 has a 5 mm inner diameter. The swirl generator 104 has a 3 mm inner diameter and is 5 mm long. Each of the helical vanes 126 of the swirl generator 104 is 0.2 mm thick and extends through 360 degrees. The increased temperature airflow outlet has an annular shape with an inner diameter of 5 mm and an outer diameter of 9 mm.

Performance

Figure 11:
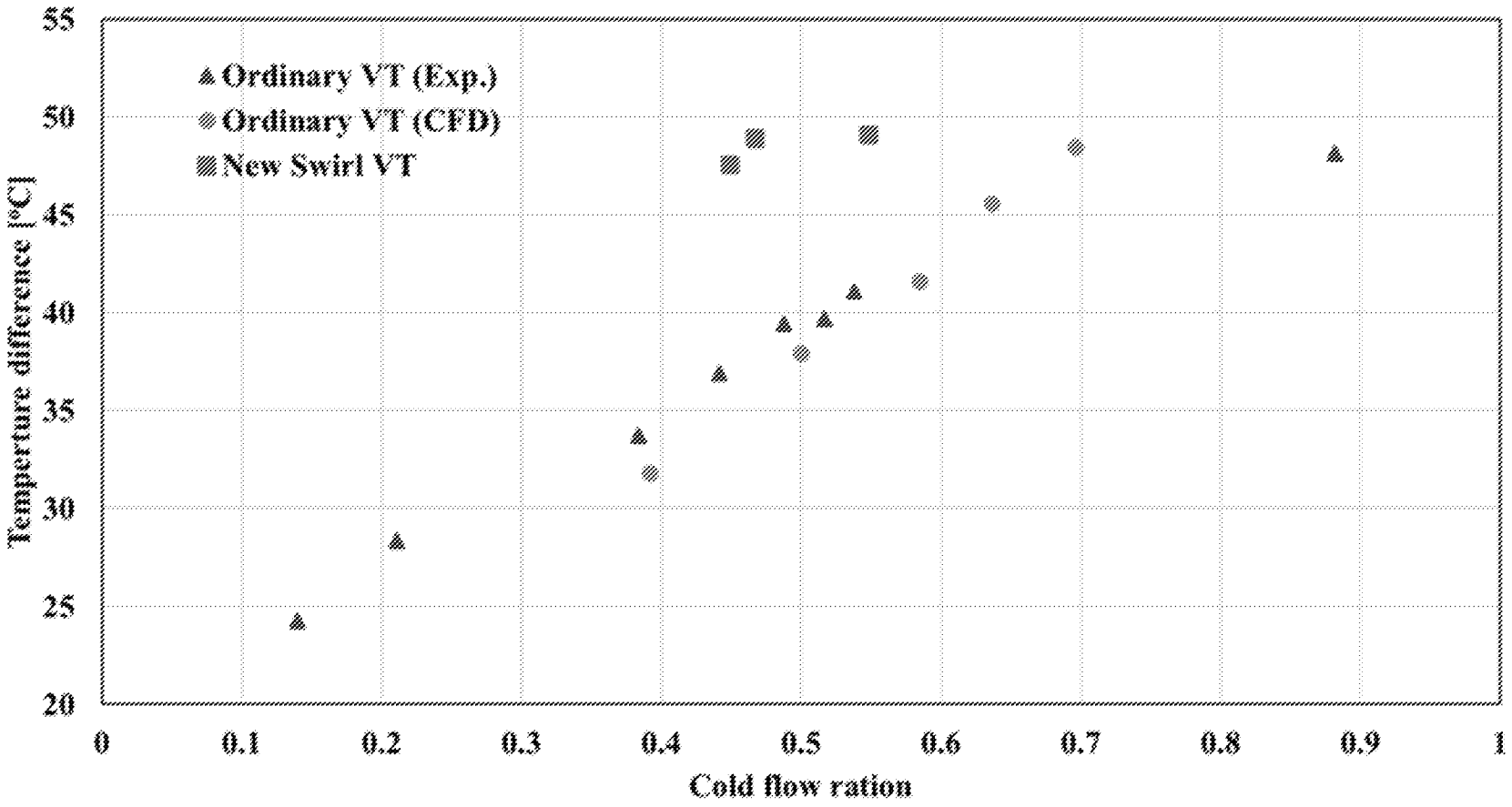
FIG. 11 shows a plot illustrating increased temperature differences between resulting hot airflow and cold airflow for some embodiments.

Computational Fluid Dynamics (CFD) analysis using ANSYS Fluent was performed to evaluate the impact of the addition of the secondary vortex generator 102. In the CFD analysis, supply of 300 kPa compressed air to both of the first vortex generator 108 and the second vortex generator 102 was simulated. The pressure at the increased temperature airflow outlet was fixed to about 100 kPa. As shown in FIG. 11, at around 0.5 mass fraction, the temperature difference for a conventional Vortex Tube 10 is approx. 40 degrees C. Applying the same operation conditions for the Vortex Tube 100 produced a temperature difference of 48 degrees C.–an 8 degree C. improvement. Additionally, the Vortex Tube 100 reduces the energy required to compress the airflow relative to a conventional Vortex Tube 10 because a higher temperature difference is achievable at a lower inlet pressure.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An airflow separator for separating an airflow having an inlet airflow temperature into a reduced temperature airflow having a reduced airflow temperature less than the inlet airflow temperature and an increased temperature airflow having an increased airflow temperature greater than the inlet airflow temperature, the airflow separator comprising:

a circulating tube having a first end and a second end, wherein the circulating tube is elongated along a circulating tube axis and defines an airflow channel having a central portion and an annular portion that surrounds the central portion;

a first vortex generator configured to receive a first portion of the airflow and inject the first portion of the airflow into the annular portion of the airflow channel at the first end with a first airflow vorticity around the circulating tube axis;

a secondary vortex generator configured to receive a second portion of the airflow, generate a second airflow vorticity around the circulating tube axis in the second portion of the airflow, and, subsequent to generation of the second airflow vorticity by the secondary vortex generator, inject the second portion of the airflow with the second airflow vorticity into the central portion of the airflow channel at the second end;

a reduced temperature airflow outlet disposed at the first end of the circulating tube and configured to receive the reduced temperature airflow from the central portion of the circulating tube; and an increased temperature airflow outlet disposed at the second end of the circulating tube and configured to receive the increased temperature airflow from the annular portion of the circulating tube.

2. The airflow separator of claim 1, wherein the airflow channel has a length-to-diameter ratio of between 10.0 and 20.0.

3. The airflow separator of claim 1, wherein the first vortex generator comprises four nozzles, wherein each of the four nozzles is configured to inject a respective portion of the first portion of the airflow into the annular portion of the airflow channel in a direction tangential to the annular portion of the airflow channel.

4. The airflow separator of claim 1, wherein the first vortex generator surrounds an end portion of the reduced temperature airflow outlet.

5. The airflow separator of claim 1, wherein the secondary vortex generator comprises helically-shaped vanes that are shaped to induce the second airflow vorticity around the circulating tube axis.

6. The airflow separator of claim 5, wherein the secondary vortex generator has a length-to-diameter ratio of between 0.8 and 3.0.

7. The airflow separator of claim 1, wherein:

the secondary vortex generator has a secondary vortex generator output orifice through which the second portion of the airflow is injected into the central portion of the airflow channel; and the secondary vortex generator output orifice has a diameter in a range of 0.45 to 0.65 of a diameter of the airflow channel.

8. The airflow separator of claim 1, wherein the increased temperature airflow outlet surrounds at least a length of the secondary vortex generator.

9. The airflow separator of claim 1, wherein the increased temperature airflow outlet has an annularly-shaped outlet orifice that is aligned with the annular portion of the airflow channel.

10. The airflow separator of claim 1, further comprising an air compressor configured to generate the airflow.

11. The airflow separator of claim 10, wherein a pressure of the first portion of the airflow supplied to the first vortex generator equals a pressure of the second portion of the airflow supplied to the secondary vortex generator.

12. The airflow separator of claim 11, wherein a flow rate the first portion of the airflow is in a range of 40.0 to 80 percent of a flow rate of the airflow.

13. The airflow separator of claim 1, wherein compressed air is supplied to each of the first vortex generator and the secondary vortex generator.

14. The airflow separator of claim 1, wherein the airflow channel is cylindrical.

15. A method of separating an airflow having an inlet airflow temperature into a reduced temperature airflow having a reduced airflow temperature less than the inlet airflow temperature and an increased temperature airflow having an increased airflow temperature greater than the inlet airflow temperature, the method comprising:

injecting a first portion of the airflow into an annular portion of a lumen of a circulating tube at a first end of the circulating tube, wherein the circulating tube has the first end and a second end, wherein the circulating tube is elongated along a circulating tube axis and defines an airflow channel having a central portion and an annular portion that surrounds the central portion, and wherein the first portion of the airflow is injected into the annular portion of the lumen so as to have a first airflow vorticity around the circulating tube axis;

generating a second airflow vorticity around the circulating tube axis in a second portion of the airflow;

subsequent to the generation of the second airflow vorticity, injecting the second portion of the airflow with the second airflow vorticity into a central portion of the lumen of the circulating tube at a second end of the circulating tube;

outputting the increased temperature airflow from the annular portion of the lumen of the circulating tube via an increased temperature airflow outlet disposed at the second end of the circulating tube; and outputting the reduced temperature airflow from the central portion of the lumen of the circulating tube via a reduced temperature airflow outlet disposed at the first end of the circulating tube.

16. The method of claim 15, wherein the injecting of the first portion of the airflow into the annular portion of the lumen of the circulating tube at the first end of the circulating tube comprises injecting respective portions of the first portion of the airflow in a direction tangential to the annular portion of the airflow channel.

* * * * *